US005938418A

United States Patent [19]

Iizuka

[11] Patent Number: 5,938,418

[45] Date of Patent: Aug. 17, 1999

[54] SCROLL TYPE FLUID DISPLACEMENT APPARATUS WITH DECREASED MANUFACTURING COST

[75] Inventor: Jiro Iizuka, Takasaki, Japan

[73] Assignee: Sanden Corporation, Gunma, Japan

[21] Appl. No.: 08/853,897

[22] Filed: May 9, 1997

[30] Foreign Application Priority Data

May 10, 1996 [JP] Japan ..... 8-116533

[51] Int. Cl.[6] ..... F01C 1/04; F01C 17/06

[52] U.S. Cl. ..... 418/55.3; 418/55.5; 418/57; 418/151; 29/888.022

[58] Field of Search ..... 418/55.3, 55.5, 418/57, 151; 29/888.022

[56] References Cited

U.S. PATENT DOCUMENTS

| | | | |
|---|---|---|---|
| 4,201,521 | 5/1980 | Carlson | 418/131 |
| 4,259,043 | 3/1981 | Hidden et al. | 418/55.3 |
| 4,406,600 | 9/1983 | Terauchi et al. | 418/55.3 |
| 4,439,118 | 3/1984 | Iimori | 418/55.5 |
| 4,466,784 | 8/1984 | Hiraga | 418/151 |
| 4,597,724 | 7/1986 | Sato et al. | 418/57 |
| 5,040,958 | 8/1991 | Arata et al. | 418/55.5 |
| 5,366,360 | 11/1994 | Bookbinder et al. | 418/55.5 |
| 5,779,461 | 7/1998 | Iisuka et al. | 418/55.5 |

FOREIGN PATENT DOCUMENTS

| | | | |
|---|---|---|---|
| 0489479 | 10/1992 | European Pat. Off. . | |
| 63-179185 | 7/1988 | Japan | 418/55.3 |
| 533811 | 2/1993 | Japan . | |

*Primary Examiner*—John J. Vrablik
*Attorney, Agent, or Firm*—Baker & Botts, L.L.P.

[57] ABSTRACT

In a scroll type fluid displacement apparatus in which a drive pin (151) is connected between a large-diameter portion (15) of a main shaft (13) and a bushing (33) rotatably held to a movable scroll (26) and which a rotation of the main shaft is transmitted to the bushing through the drive pin to make the movable scroll have an orbital motion around a predetermined axis, a balance weight (331) attached to the bushing has a positioning projection (331c) which is engaged with the large-diameter portion in a rotation direction of the bushing. Therefore, the movable scroll is positioned relative to the main shaft. In addition, the movable scroll defines fluid pockets in cooperation with a fixed scroll (25) therebetween. When the orbital motion of the movable scroll is caused in dependence on rotation of the main shaft with inhibiting rotation of the movable scroll around the predetermined axis, the fluid pockets are displaced between the movable and the fixed scrolls.

10 Claims, 5 Drawing Sheets

SCROLL TYPE FLUID DISPLACEMENT APPARATUS WITH DECREASED MANUFACTURING COST

BACKGROUND OF THE INVENTION

The present invention relates to a scroll type fluid displacement apparatus and, in particular, to a driving mechanism for an orbiting or movable scroll in the scroll type fluid displacement apparatus.

For example, U.S. Pat. No. 4,597,724 discloses a conventional scroll type fluid displacement apparatus including a fixed scroll, a movable scroll coupled to the fixed scroll, and a driving mechanism which is for causing a circular orbital motion of the movable scroll in dependence on a rotation of a main shaft. The orbital motion causes fluid pockets formed between the fixed scroll and the movable scroll to move and change their volumes to thereby compress introduced fluid. Accordingly, such a scroll type fluid displacement apparatus may be called a scroll type compressor.

In such a scroll type fluid displacement apparatus, it is necessary to inhibit the rotation of the movable scroll on its axis while performing the orbital motion. For this purpose, a rotation inhibiting mechanism is further provided in the fluid displacement apparatus.

As appreciated, when using a ball coupling mechanism or an Oldham's coupling mechanism as such a rotation inhibiting mechanism, the lower limit of a radius of the orbital motion of the movable scroll can not be regulated. Thus, for example, it is possible that a radius of the orbital motion of the movable scroll becomes so small upon start-up of the fluid displacement apparatus that the fluid displacement apparatus does not start the displacing operation.

Furthermore, when using the Oldham's coupling mechanism as such a rotation inhibiting mechanism, the upper limit of the orbital motion radius can not be regulated. Thus, upon mounting the movable scroll via the Oldham's coupling mechanism in an apparatus housing, a balance weight largely swings to interfere with the inner periphery of the apparatus housing.

Under the circumstances, a swing regulating mechanism is further required in the conventional fluid displacement apparatus for regulating a swing magnitude (orbital motion radius) of the movable scroll. In the conventional fluid displacement apparatus, the swing regulating mechanism is further utilized for facilitating assembling of the movable scroll.

On the other hand, provision of such a swing regulating mechanism causes the increase in manufacturing cost of the fluid displacement apparatus.

SUMMARY OF THE INVENTION

It is therefore an object of the present invention to provide a scroll type fluid displacement apparatus in which a manufacturing cost can be decreased.

It is another object of the present invention to provide a scroll type fluid displacement apparatus of the type described, which is easy in assembling and capable of achieving the stable apparatus performance.

Other objects of this invention will become clear from the description proceeds.

A scroll type fluid displacement apparatus to which this invention is applicable comprises a housing with a front end plate a fixed scroll, a movable scroll coupled to the fixed scroll for defining fluid pockets in cooperation with the fixed scroll therebetween, a main shaft to be rotated around a predetermined axis, a driving mechanism connected to the movable scroll and the main shaft for making the movable scroll have an orbital motion around the predetermined axis relative to the fixed scroll in dependence on rotation of the main shaft to displace the fluid pockets, and a rotation inhibiting mechanism connected between the front end plate and the movable scroll for inhibiting rotation of the movable scroll around the predetermined axis. In the scroll type fluid displacement apparatus, the driving mechanism comprises a large-diameter portion integral with the main shaft, a bushing facing the large-diameter portion and rotatably held to the movable scroll, a balance weight interposed between the large-diameter portion and the bushing and attached to the bushing, and a drive pin connected to an eccentric portion of the large-diameter portion and to an eccentric portion of the bushing for transmitting the rotation of the main shaft to the bushing to cause the orbital motion of the movable scroll. In the driving mechanism, the balance weight has a deteriorating projection which is engaged with the large-diameter portion in a rotation direction of said bushing wherein the projection positions the movable scroll relative to the large-diameter portion and the projection is adapted to deteriorate during operation of said driving mechanism.

DESCRIPTION OF THE PREFERRED EMBODIMENT

For a better understanding of the present invention, description will be made at first as regards a conventional scroll type fluid displacement apparatus which includes a driving mechanism for causing a circular orbital motion of a movable scroll relative to a fixed scroll as discussed in the preamble part.

Figure 1:
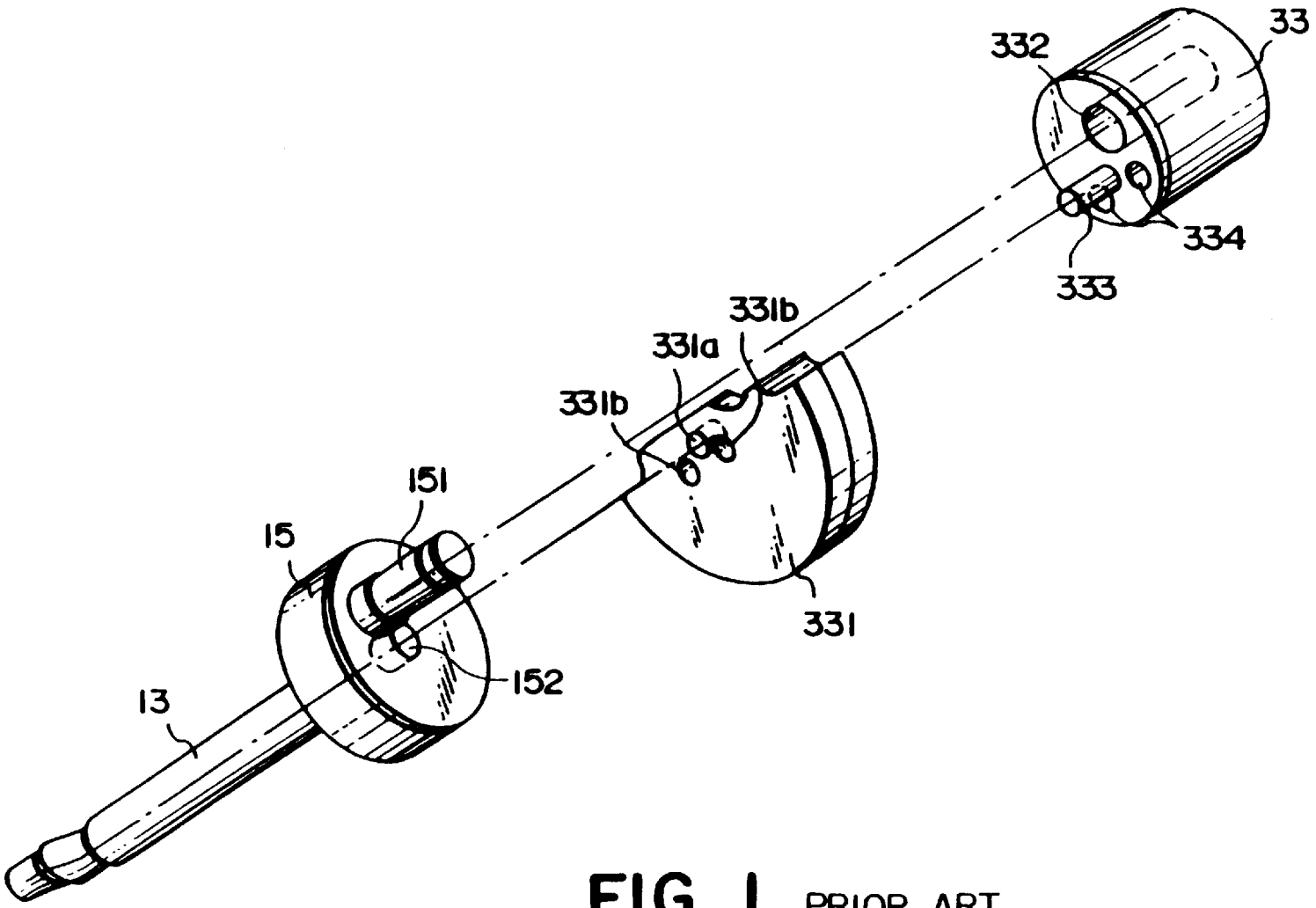
FIG. 1 PRIOR ART
FIG. 1 is an exploded perspective view of a driving mechanism included in a conventional scroll type fluid displacement apparatus.

Referring to FIG. 1, the driving mechanism will be described. In the driving mechanism, a main shaft 13 is formed with a main shaft large-diameter portion 15. A drive pin 151 is fixed to an end surface of the large-diameter portion 15 at a position offset from the center thereof and projects in an axial direction of the main shaft 13 but away from the main shaft 13. Further, at the center of the large-diameter portion 15 is bored a swing regulating hole 152.

The movable scroll (not shown) includes an end plate and a spiral element fixed to the end plate at one side thereof. At the other side of the end plate, an annular boss (not shown) is further provided. A thick disc-shaped bushing 33 is received in the boss and rotatably supported via a needle bearing (not shown). A semidisc-shaped balance weight 331 is attached to the bushing 33 so as to extend in a radial direction of the bushing 33.

The bushing 33 is formed with an eccentric hole 332 at a position offset from the center and further formed with a swing regulating projection 333 at a position offset from the center. The bushing 33 is further formed with a pair of rivet holes 334. On the other hand, an insertion hole 331*a* is formed at the virtual center of the semidisc-shaped balance weight 331 assuming it is disc-shaped, and a pair of rivet holes 331*b* are further formed at positions offset from the insertion hole 331*a*.

The balance weight 331 is fixed to the bushing 33 through rivet connection, that is, by inserting a rivet into one pair of the rivet holes 334, 331*b* and another rivet into the other pair of the rivet holes 334, 331*b*. In this case, the swing regulating projection 333 passes through the insertion hole 331*a* and is further inserted into the swing regulating hole 152. On the other hand, the drive pin 151 is rotatably received in the eccentric hole 332. A combination of the swing regulating projection 333 and the swing regulating hole 152 will be referred to as a swing regulating mechanism for regulating a swing magnitude (orbital motion radius) of the movable scroll.

However, for providing the swing regulating projection 333, the bushing 33 should be formed through forging and further a special cutting work, such as an eccentric processing, is necessary. This increases the manufacturing cost of the bushing.

On the other hand, if the swing regulating mechanism is not provided, positioning of the movable scroll relative to the main shaft becomes difficult.

Turning to FIGS. 2–7, the description will be made as regards a scroll type fluid displacement apparatus according to an embodiment of the present invention. Similar parts will be designated by like reference numerals.

In the following description, the left side of FIG. 2 will represent the front side of the fluid displacement apparatus while the right side thereof will represent the rear side of the compressor, which is only for the sake of convenience of description and is not intended to limit the invention in any way. The fluid displacement apparatus is for compressing fluid and therefore will be called hereinafter a scroll type compressor.

Figure 2:
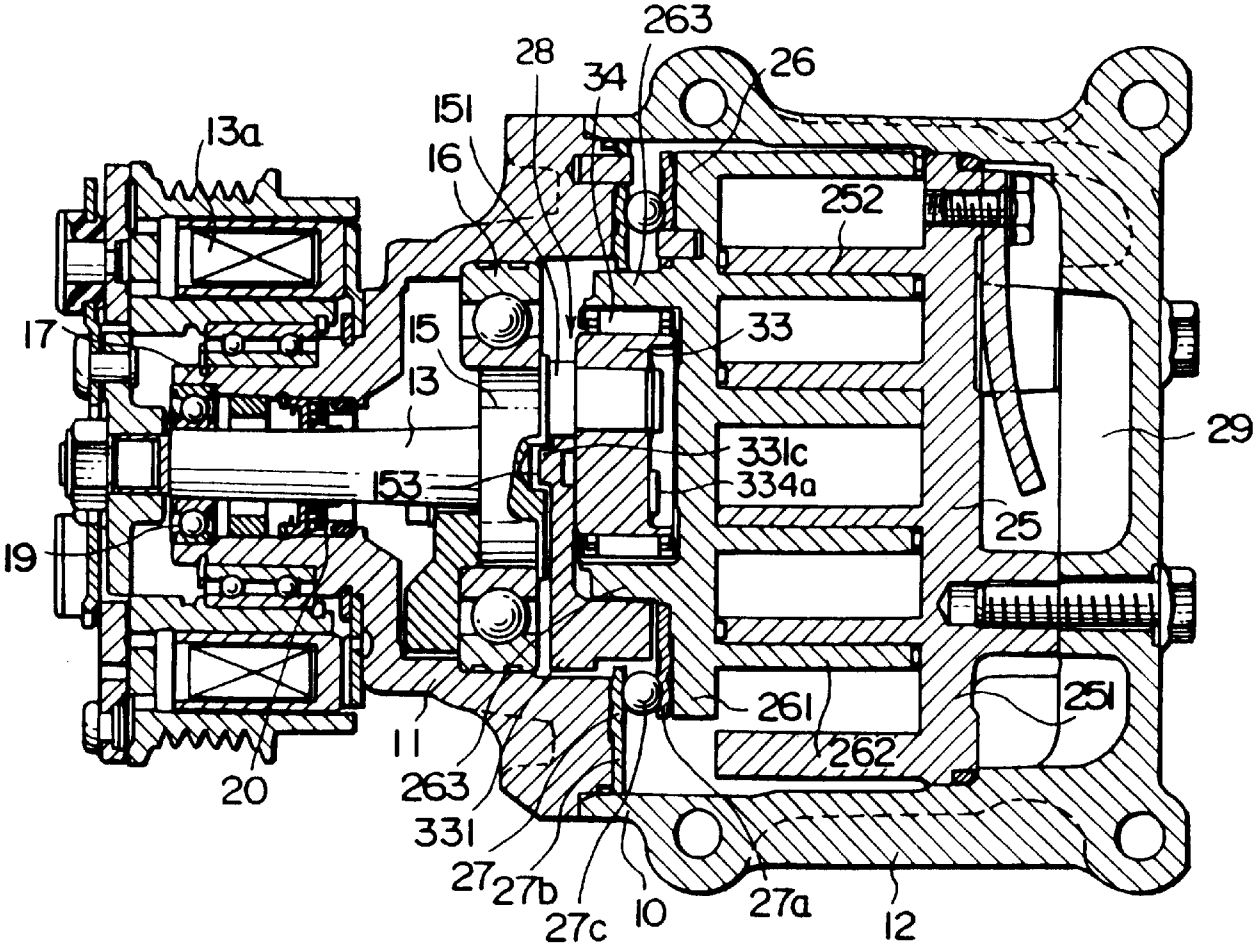
FIG. 2 is a longitudinal sectional view of a scroll type fluid displacement apparatus according to an embodiment of the present invention.
Figure 3:
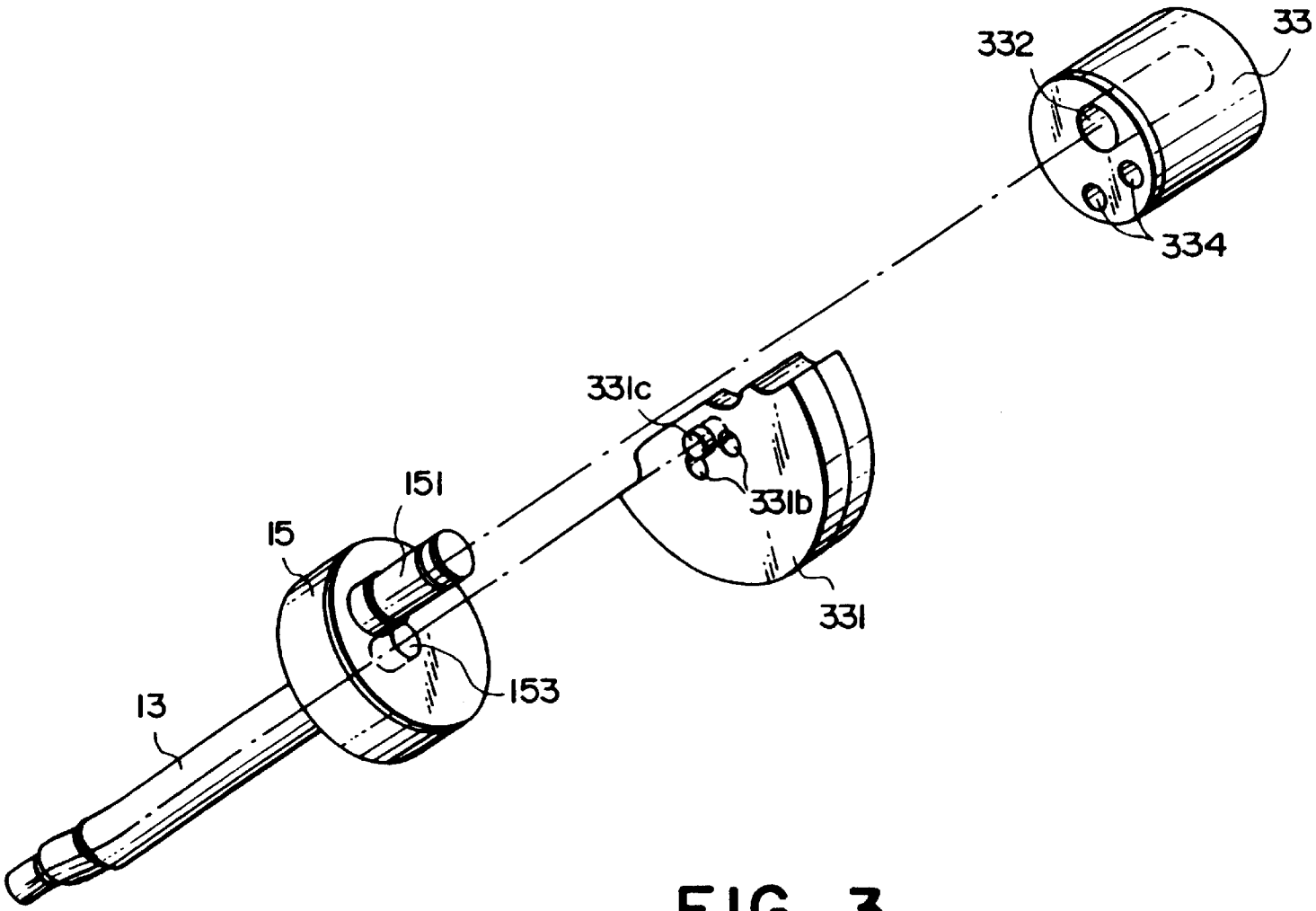
FIG. 3 is an exploded perspective view of a driving mechanism included in the scroll type fluid displacement apparatus of FIG. 2.
Figure 4:
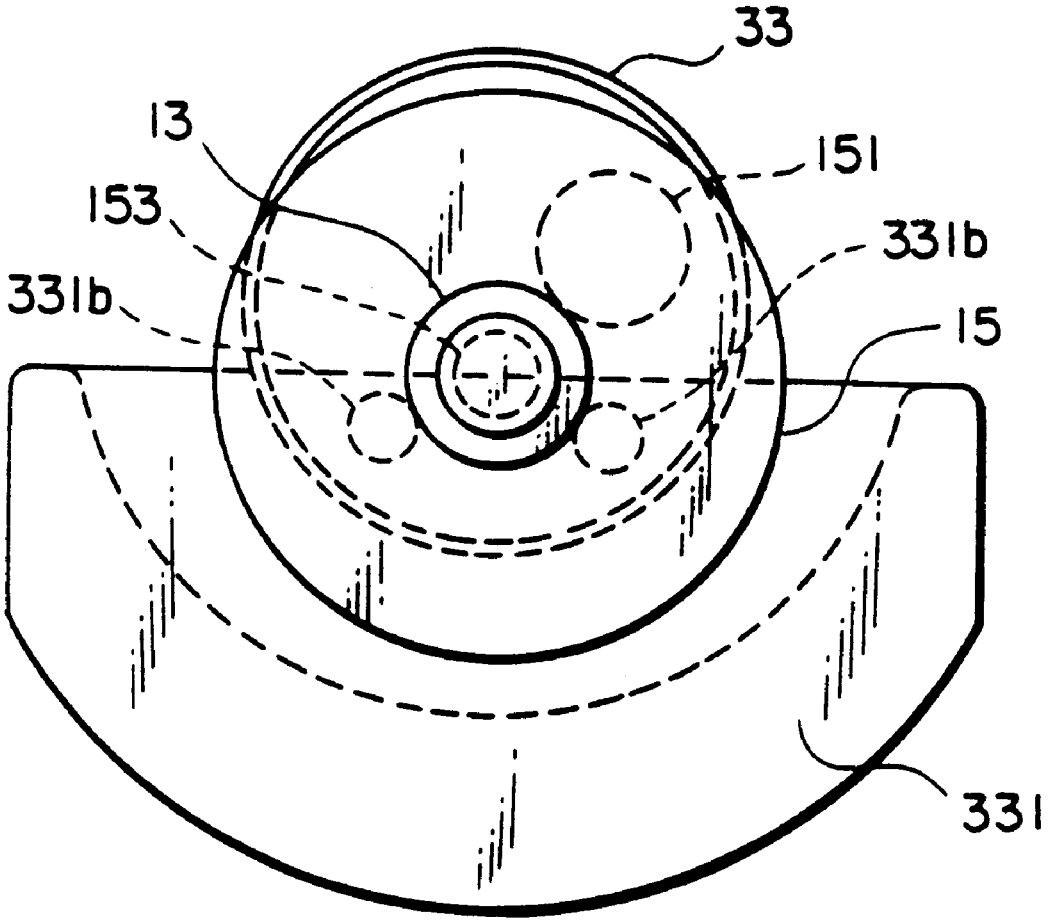
FIG. 4 is a front view of the driving mechanism.
Figure 5:
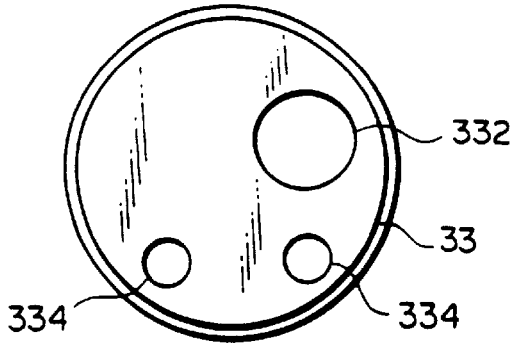
FIG. 5 is a front view of a bushing included in the driving mechanism.
Figure 6:
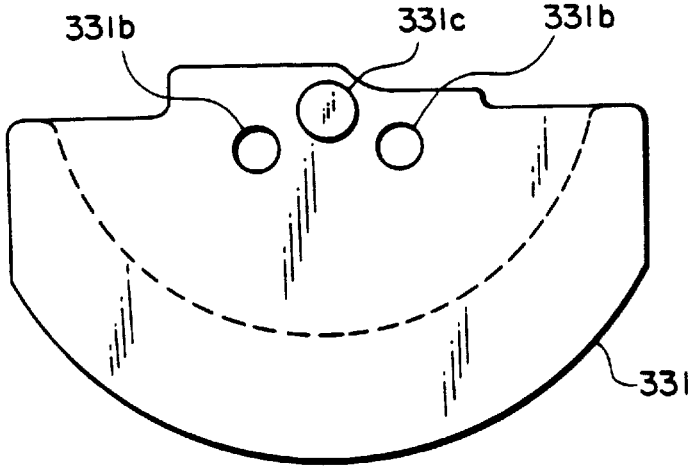
FIG. 6 is a front view of a balance weight included in the driving mechanism.
Figure 7:
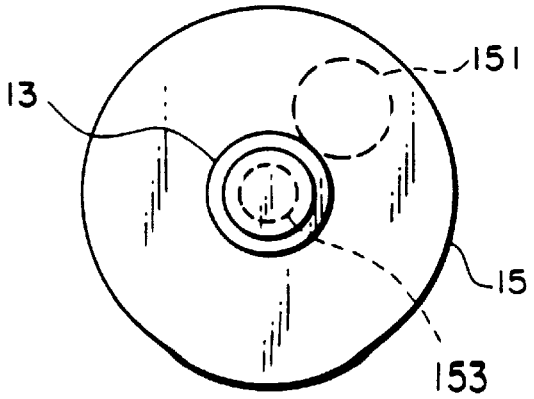
FIG. 7 is a front view of a main shaft included in the driving mechanism.

As shown in FIG. 2, the compressor includes a compressor housing 10. The compressor housing 10 includes a funnel-shaped front end plate (front housing) 11 and a cup-shaped casing 12. The main shaft (crankshaft) 13 passes through the front end plate 11 and is formed with the main shaft large-diameter portion 15 at its axially inner end. The large-diameter portion 15 is rotatably supported by the front end plate 11 via a ball bearing 16 interposed therebetween.

The front end plate 11 has a sleeve 17 extending forward and encircling the main shaft 13. A ball bearing 19 is disposed at a front end of the sleeve 17 so as to rotatably support the main shaft 13. A shaft seal unit 20 is disposed on the main shaft 13 for sealing thereof. The rotation of an external driving source, such as an automobile engine, is transmitted to the main shaft 13 via an electromagnetic clutch 13*a*.

Within the cup-shaped casing 12 are disposed a fixed scroll 25, a movable scroll 26, a rotation inhibiting mechanism 27 and a driving mechanism 28.

The fixed scroll 25 includes a circular end plate 251 and a spiral element 252 fixed to the end plate 251 at one side thereof. The end plate 251 is fixed to the cup-shaped casing 12. The movable scroll 26 includes a circular end plate 261 and a spiral element 262 fixed to the end plate 261 at one side thereof.

The spiral element 262 is interfitted or mated with the spiral element 252 with a phase deviation of 180 degrees so as to define fluid pockets therebetween. The movable scroll 26 is coupled to the rotation inhibiting mechanism 27 so as to be prevented from rotation on its axis. On the other hand, the movable scroll 26 makes an orbital motion on a given circular orbit depending on the rotation of the main shaft 13 through the driving mechanism 28. The orbital motion of the movable scroll 26 compresses the introduced fluid as in the known manner. Specifically, the fluid sucked through a suction port (not shown) is introduced into the fluid pockets which move toward the center while changing their volumes depending on the orbital motion of the movable scroll 26 so as to compress the fluid. The compressed fluid is then discharged into a discharge chamber 29 through a discharge hole (not shown) bored through the end plate 251.

As shown in FIGS. 3–7, the description will be directed to the driving mechanism 28. In the driving mechanism 28, the drive pin 151 is fixed to an end surface of the main shaft large-diameter portion 15 at a position offset from the center thereof and projects in an axial direction of the main shaft 13 but away from the main shaft 13. Further, at the center of the large-diameter portion 15 is bored a positioning hole 153 corresponding to the swing regulating hole (152 in FIG. 1).

An annular boss 263 is provided on the end plate 261 of the movable scroll 26 on a side thereof opposite to the side where the spiral element 262 is provided. The thick disc-shaped bushing 33 is received in the boss 263 and rotatably supported via a needle bearing 34. The semidisc-shaped balance weight 331 is attached to the bushing 33 so as to extend in a radial direction of the bushing 33.

The bushing 33 is formed with the eccentric hole 332 at a position offset from the center and further formed with the rivet holes 334. On the other hand, a positioning projection 331*c* is formed at the virtual center of the semidisc-shaped balance weight 331 assuming it is disc-shaped, and the rivet holes 331*b* are further formed at positions offset from the positioning projection 331*c*. The positioning projection 331*c* has a diameter slightly smaller than that of the positioning hole 153 and is formed by half-blanking a corresponding portion of the balance weight 331 through a press work.

The balance weight 331 is fixed to the bushing 33 through rivet connection, that is, by inserting a rivet into one pair of the rivet holes 334, 331*b* and another rivet into the other pair of the rivet holes 334, 331*b*. Then, the positioning projection 331*c* is inserted into the positioning hole 153. On the other hand, the drive pin 151 is received in the eccentric hole 332 and rotatably supported by a needle bearing (not shown).

Referring back to FIG. 2, the rotation inhibiting mechanism 27 includes a pair of annular races 27*a* and 27*b* and a plurality of balls 27*c* arranged between the annular races 27*a* and 27*b* at regular intervals in a circumferential direction thereof. The race 27*a* is fixed to the end plate 261 of the movable scroll 26, while the race 27*b* is fixed to the front end plate 11. On each of the confronting surfaces of the races 27*a* and 27*b*, a plurality of annular grooves are formed at regular intervals in the circumferential direction for receiving therein the corresponding balls 27*c*, respectively. Each groove has a cross section of a circular arc having a radius of curvature slightly greater than that of the ball 27*c* so that each ball 27*c* rolls along the corresponding pair of grooves of the races 27*a* and 27*b*. A diameter of a circular orbit along a bottom of each groove is set substantially equal to a radius of the orbital motion of the movable scroll 26. With this arrangement of the rotation inhibiting mechanism 27, the radius of the orbital motion of the movable scroll 26 can be regulated in terms of both the upper and lower limits.

When the main shaft 13 rotates, the bushing 33 makes an orbital motion due to the movement of the drive pin 151. As a result, the center of the movable scroll 26 revolves or orbits around an axis of the main shaft 13. Since the rotation of the movable scroll 26 on its axis is inhibited by the rotation inhibiting mechanism 27, the movable scroll 26 only makes the orbital motion. As described before, when the movable scroll 26 makes the orbital motion, the compression of the fluid is achieved.

In the compressor, the rotation inhibiting mechanism 27 regulates the radius of the orbital motion of the movable scroll 26 in terms of both the upper and lower limits. Thus, the stable compressor performance can be achieved upon start-up of the compressor and during the compression of the fluid without providing the swing regulating projection on the bushing 33 as is required in the prior art.

Further, in the compressor, the positioning of the movable scroll 26 relative to the main shaft 13 is performed by the engagement between the positioning hole 153 formed in the main shaft large-diameter portion 15 and the positioning projection 331*c* formed on the balance weight 331. In other words, the positioning projection 331*c* is inserted into the positioning hole 153 on carrying out an operation in which the main shaft 13 is coupled to the movable scroll 26. After the main shaft 13 is coupled to the movable scroll 26, the positioning projection 331*c* becomes unnecessary. Therefore, the positioning projection 331*c* may be worn out as a result of an operation of the compressor.

With this structure, it is unnecessary to provide a projection on the bushing 33. This results in enabling the bushing 33 being readily manufactured from a steel rod sold at a market. Thus, the manufacturing cost of the bushing can be reduced, while assembling of the movable scroll 26 is facilitated.

While this invention has thus far been described in conjunction with a single embodiment, it will readily be understood for those skilled in the art to put this invention into practice in various other manners. For example, as the rotation inhibiting mechanism, use may be made of a selected one of similar mechanisms known in the art. Japanese Laid-open (Unexamined) Patent Publication No. 33811/1993 (JP-A-5-33811), the disclosure of which is herein incorporated by reference, discloses a thrust ball bearing which forms the rotation inhibiting mechanism included in the compressor of this specification.

What is claimed is:

1. A scroll type fluid displacement apparatus comprising:

a housing with a front end plate:

a fixed scroll;

a movable scroll coupled to said fixed scroll for defining fluid pockets in cooperation with said fixed scroll therebetween;

a main shaft to be rotated around a predetermined axis;

a driving mechanism connected to said movable scroll and said main shaft for making said movable scroll have an orbital motion around said predetermined axis relative to said fixed scroll in dependence on rotation of said main shaft to displace said fluid pockets;

and a rotation inhibiting mechanism connected between said front end plate and said movable scroll for inhibiting rotation of said movable scroll around said predetermined axis, said driving mechanism comprising:

a large-diameter portion integral with said main shaft, said large-diameter portion having a positioning hole;

a bushing facing said large-diameter portion and rotatably held to said movable scroll;

a balance weight interposed between said large-diameter portion and said bushing and attached to said bushing; and a drive pin connected to an eccentric portion of said large-diameter portion and to an eccentric portion of said bushing for transmitting said rotation of the main shaft to said bushing to cause said orbital motion of the movable scroll, said balance weight having a deteriorating projection which is engaged with said positioning hole of said large-diameter portion during assembly of said driving mechanism, wherein said projection positions said movable scroll relative to said large-diameter portion and said projection is adapted to deteriorate during operation of said driving mechanism.

2. A scroll type fluid displacement apparatus as claimed in claim 1, wherein said bushing has an eccentric hole at said eccentric portion thereof, said drive pin being fixed to said large-diameter portion at said eccentric portion thereof and inserted into said eccentric hole.

3. A scroll type fluid displacement apparatus as claimed in claim 1, wherein said positioning hole is on said predetermined axis, and said projection extends parallel to said predetermined axis.

4. A scroll type fluid displacement apparatus as claimed in claim 1, wherein said projection includes a half-banked corresponding portion of said balance weight.

5. A scroll type fluid displacement apparatus as claimed in claim 1, wherein said projection is for regulating a swing of said bushing relative to said large-diameter portion around said drive pin to determine a radius of the orbital motion of said movable scroll in cooperation with said drive pin.

6. A scroll type fluid displacement apparatus as claimed in claim 1, wherein said rotation inhibiting mechanism comprises orbit regulating means connected to said front end plate and said movable scrolls for regulating a radius of the orbital motion of said movable scroll.

7. A scroll type fluid displacement apparatus as claimed in claim 6, wherein said orbit regulating means comprises:

a plurality of movable annular grooves connected to said movable scroll, said movable annular grooves arranged at regular intervals in a circumferential direction of said movable scroll;

a plurality of fixed annular grooves connected to said front end plate, said fixed annular grooves arranged at regular intervals in a circumferential direction of said front end plate and facing said movable annular grooves; and a plurality of balls arranged between said movable annular grooves and said fixed annular grooves, each of said balls received in a corresponding pair of said movable annular grooves and said fixed annular grooves.

8. A scroll type fluid displacement apparatus as claimed in claim 7, wherein each of said movable and said fixed annular grooves has a diameter substantially equal to the radius of the orbital motion of said movable scroll.

9. A scroll type fluid displacement apparatus as claimed in claim 7, wherein each of said movable and said fixed annular grooves has a cross section of a circular arc having a radius of curvature slightly greater than that of said ball.

10. A scroll type fluid displacement apparatus as claimed in claim 1, wherein said projection is for positioning said bushing relative to said large-diameter portion in cooperation with said drive pin.

* * * * *